US009850681B2

(12) United States Patent
Le

(10) Patent No.: US 9,850,681 B2
(45) Date of Patent: Dec. 26, 2017

(54) PORTABLE BED APPARATUS AND METHOD OF USE

(71) Applicant: Tu Van Anh Le, Lakeland, TN (US)

(72) Inventor: Tu Van Anh Le, Lakeland, TN (US)

( * ) Notice: Subject to any disclaimer, the term of this patent is extended or adjusted under 35 U.S.C. 154(b) by 130 days.

(21) Appl. No.: 14/948,738

(22) Filed: Nov. 23, 2015

(65) Prior Publication Data

US 2016/0143451 A1 May 26, 2016

Related U.S. Application Data

(60) Provisional application No. 62/083,350, filed on Nov. 24, 2014.

(51) Int. Cl.

| | |
|---|---|
| ***E04H 15/38*** | (2006.01) |
| ***E04H 15/48*** | (2006.01) |
| ***A47C 17/64*** | (2006.01) |
| ***A47C 17/70*** | (2006.01) |
| *E04H 15/02* | (2006.01) |

(Continued)

(52) U.S. Cl.

CPC ..... *E04H 15/38* (2013.01); *A47C 17/64* (2013.01); *A47C 17/70* (2013.01); *E04H 15/48* (2013.01); *A47C 29/006* (2013.01); *A47C 31/007* (2013.01); *E04H 15/02* (2013.01)

(58) Field of Classification Search

CPC ..... E04H 15/322; E04H 15/34; E04H 15/36; E04H 15/38; E04H 15/48; E04H 15/324; E04H 15/02; E04H 15/405; A47C 17/64; A47C 17/66; A47C 17/70; A47C 29/00; A47C 29/003

See application file for complete search history.

(56) References Cited

U.S. PATENT DOCUMENTS 1,819,490 A * 8/1931 Weiss ..... E04H 15/38 135/132
2,798,501 A * 7/1957 Oliver ..... B60J 11/00 135/134

(Continued)

FOREIGN PATENT DOCUMENTS

GB 862011 A * 3/1961 ..... E04H 15/38

*Primary Examiner* — David R Dunn
*Assistant Examiner* — Danielle Jackson
(74) *Attorney, Agent, or Firm* — Veritay Group, IP; Susan Fentress

(57) ABSTRACT

The subject matter described herein includes a portable bed apparatus, and method of use. One aspect of this invention includes a storage container for a foldable bed frame and sleeping ware and a foldable bed frame made of a plurality of bed panel frames. The storage container is expandable to form an insect resistant frame having a base and a dome. In another aspect of this invention, the frame of insect resistant net is made of a plurality of generally rectangular shaped members and a plurality of connecting members, wherein each end of the plurality of rectangular shaped members are positioned in one of the plurality of connecting members. In the extended position at least two of the plurality of generally rectangular members are substantially parallel to the plurality of connecting members forming a base to receive the bedding and to retain a net; and at least two of the plurality of rectangular members of the plurality of rectangular members form a dome to define a space above the bedding and to retain the insect non-permeable net.

3 Claims, 10 Drawing Sheets

(51) Int. Cl.
*A47C 29/00* (2006.01)
*A47C 31/00* (2006.01)

(56) References Cited

U.S. PATENT DOCUMENTS 3,121,439 A * 2/1964 Moltchan ..... E04H 15/38
135/126
3,171,417 A * 3/1965 Stokes ..... E04H 6/04
135/132
3,513,861 A * 5/1970 Johnson ..... E04H 15/38
135/132
3,601,825 A * 8/1971 Moorhead ..... A47C 29/003
135/117
3,906,968 A * 9/1975 Black ..... E04H 15/38
135/132
3,995,649 A * 12/1976 Robichaud ..... E04H 15/06
135/133
5,740,826 A * 4/1998 Nevin ..... E04H 6/04
135/133
7,971,596 B2 * 7/2011 Morris ..... A47C 29/003
135/133
D642,701 S * 8/2011 Howard ..... D25/15
D776,776 S * 1/2017 Le ..... D21/834
9,765,545 B1 * 9/2017 Petrenko ..... E04H 6/04
2010/0126546 A1 * 5/2010 Chen ..... E04H 15/38
135/126
2012/0042920 A1 * 2/2012 Armstrong ..... E04H 15/003
135/153

* cited by examiner

PORTABLE BED APPARATUS AND METHOD OF USE

CROSS REFERENCE TO RELATED APPLICATIONS

This application is a non-provisional application of U.S. provisional No. 62/083,350 filed Nov. 24, 2014 under 35 U.S.C. §119(e) (hereby incorporated by reference in its entirety).

FIELD OF THE INVENTION

This invention relates to a portable bed apparatus and method of use.

BACKGROUND OF THE INVENTION

Portable bed rolls are known in the art for camping and inflatable mattresses for home use are known in the art; however, a comfortable self-contained portable bed apparatus that can include insect netting is lacking in the prior art.

SUMMARY OF THE INVENTION

The subject matter described herein includes a portable bed apparatus, and method of use the portable bed apparatus. The portable bed apparatus features an insect resistant frame made of a base and a dome. In one embodiment, the insect resistant frame is made of a plurality of generally rectangular shaped members and a plurality of connecting members, wherein each end of the plurality of rectangular shaped members are positioned in one of the plurality of connecting members. In the compressed position, the plurality of rectangular members are substantially perpendicular to the plurality of connecting members. In the extended position, at least two of the plurality of generally rectangular members are substantially parallel to the plurality of connecting members forming a base to receive the bedding and to retain a net; and at least two of the plurality of rectangular members of the plurality of rectangular members form a dome to define a space above the bedding and to retain the insect non-permeable net.

Another embodiment of this invention includes a storage container for a foldable bed frame and sleeping ware and a foldable bed frame made of a plurality of bed panel frames, each of the plurality of bed panel frames being joined by a plurality of hinges, preferably a pair of hinges. The storage container is expandable to form an insect resistant frame having a base and a dome. The insect resistant frame has a base and a dome which can be transformed into a storage container defined by four long side panels and two short top panels, the storage container is sized to contain a foldable bed frame, when the foldable bed frame is in the folded position; wherein the four long side panels have a plurality of re-sealable openings located between the long side panels, and wherein the storage container expands to form an insect resistant frame having a base and a dome, when the re-sealable openings located between the long side panels.

DETAILED DESCRIPTION OF THE INVENTION

Figure 1A:
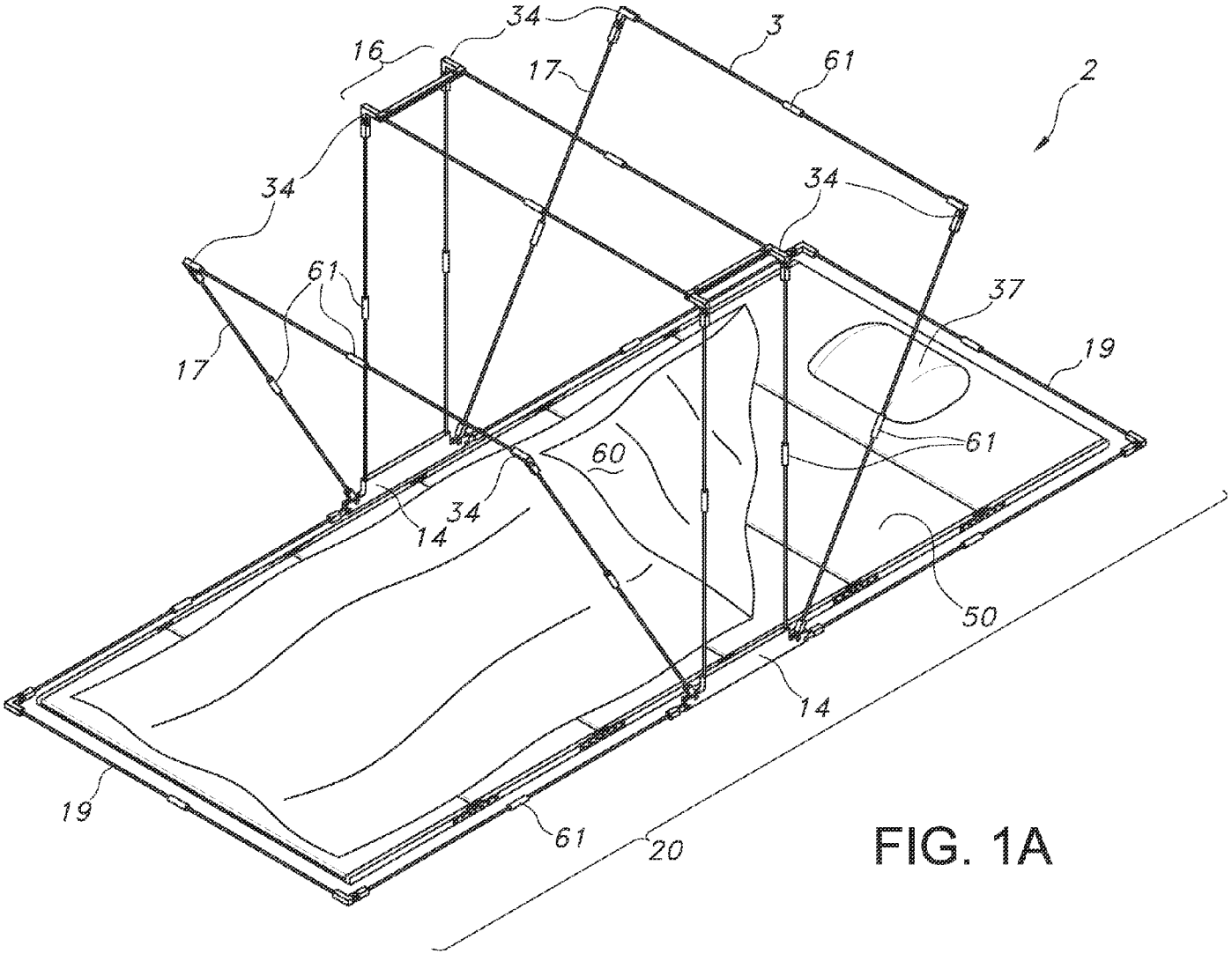
FIG. 1A is a perspective view of a portable bed apparatus of the present invention in the extended configuration.

The present invention may be understood more readily by reference to the following detailed description of the invention. It is to be understood that this invention is not limited to the specific devices, methods, conditions or parameters described herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Unless defined otherwise, all technical terms used herein have the same meaning as commonly by one ordinary skilled in the art to which this invention belongs.

Now referring to FIGS. 1A-C and 2C a portable bed apparatus 2 is made of an insect resistant frame 3 and a plurality of connecting members 14. In this exemplary embodiment, the insect resistant frame 3 is made of a plurality of generally rectangular shaped members 16, 17, 19. Each end of the plurality of generally rectangular shaped members 16, 17, 19 is positioned in one of the plurality of connecting members 14. A first set of rectangular shaped members 16 are fixed in the plurality of connecting members 14. A second set of rectangular shaped members 17 are flexibly attached to the plurality of connecting members 14 and can pivot 45 degrees relative to the first set of rectangular shaped members 16. A third set of rectangular shaped members 19 are flexibly attached to the plurality of connecting members 14 and can pivot 90 degrees relative to the first set of rectangular shaped members 16.

Figure 2A:
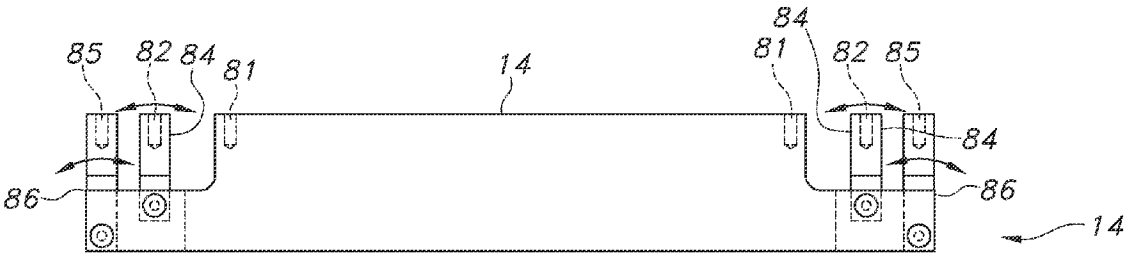
FIG. 2A is an exemplary embodiment of one of the plurality of the connecting members.
Figure 2B:
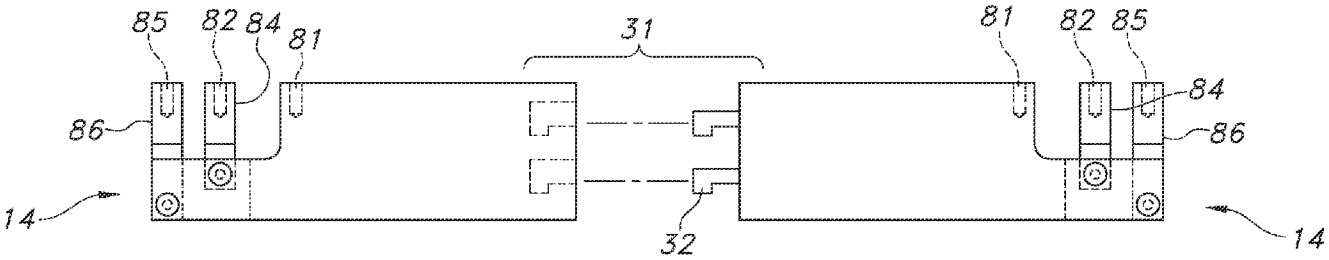
FIG. 2B is an exemplary embodiment of one of the plurality of the connecting members.
Figure 2C:
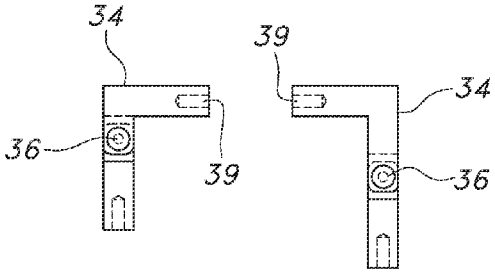
FIG. 2C is an exemplary embodiment of a connecting hinge.

In one embodiment, as shown in FIG. 2C, a hinge 34 includes a slot 39 that is configured to receive the end of plurality of generally rectangular shaped members 16, 17, 19 to facilitate the formation of a generally rectangular shape. In an exemplary embodiment, one leg of the U shaped hinge 34 is shorter than the other so that one leg can be folded over the other.

When the insect resistant frame 3 is in the extended position shown in FIG. 1A, the third set of rectangular shaped members 19 are substantially parallel to the plurality of connecting members 14 and form a generally rectangular base 20 area configured to receive the associated sleeping ware, such as a bed cushion 50, cover sheet 60, blanket (not shown) and pillow 37.

Figure 1B:
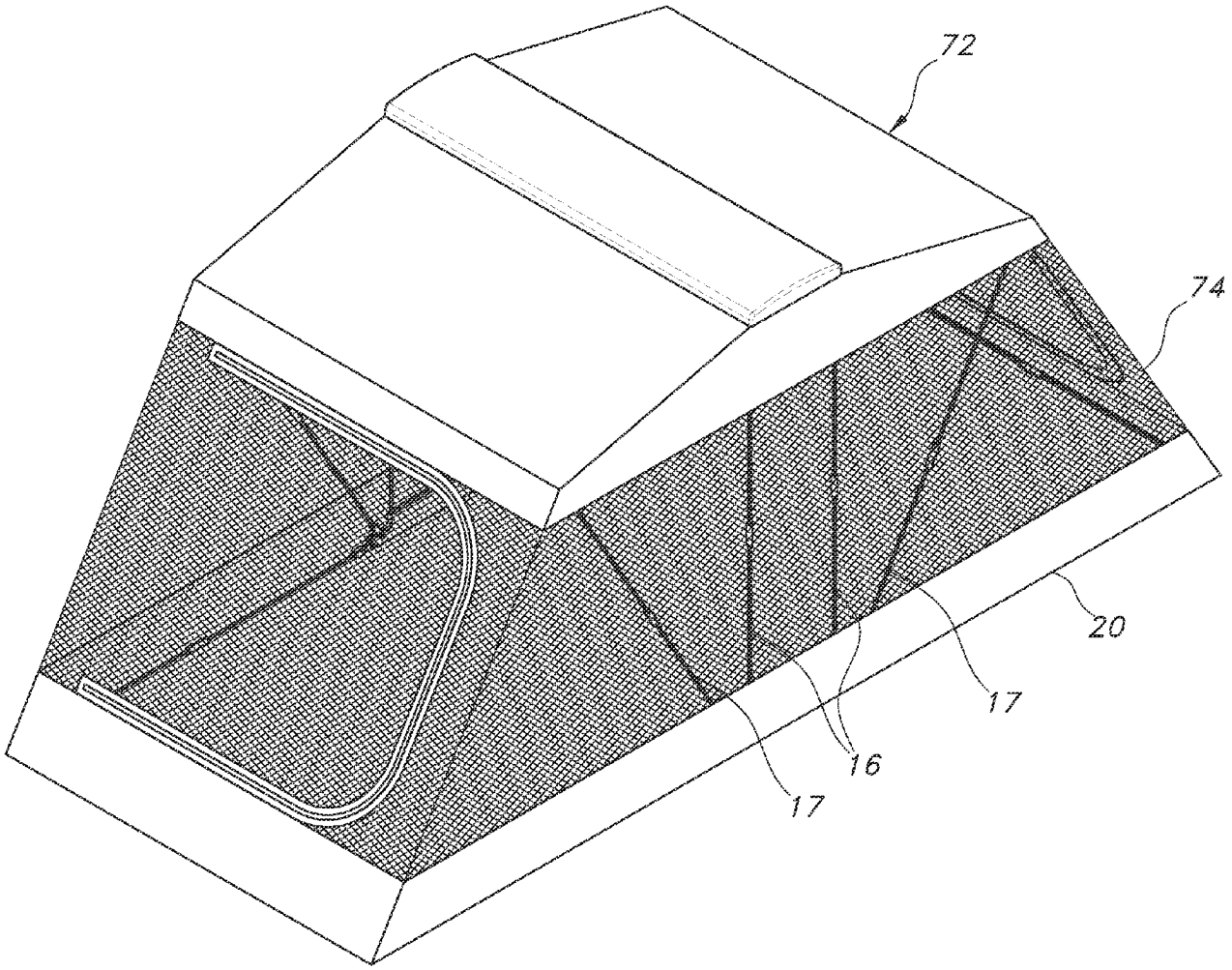
FIG. 1B is a perspective view of a portable bed apparatus of the present invention with an exemplary dome.

FIG. 1B is a perspective view of a portable bed apparatus 2 of the present invention with the insect resistant frame 3 having an insect resistant covering to form a dome 72. The second set of rectangular shaped members 17 are flexibly attached to the plurality of connecting members 14, pivot 45 degrees relative to the first set of rectangular shaped members 16 to form a dome 72. A first set of rectangular shaped members 16 are fixed in the plurality of connecting members 14 and form the top portion of dome 72. The first set of rectangular shaped members 16 and the second set of rectangular shaped members 17 form a dome 72 to define a space above the bedding and to retain the insect resistant net 74. It is understood that the insect resistant frame 3 can include additional rectangular shaped members between the first set of rectangular shaped members 16 and third set of rectangular shaped members 19 to further define the dome 72. In one exemplary embodiment, the insect resistant net 74 is affixed to the dome 72 by ties or tabs.

Figure 1C:
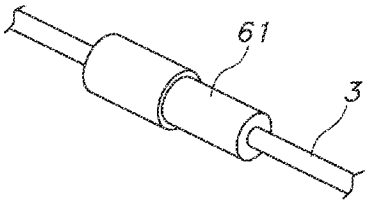
FIG. 1C is a perspective view of an adjustable rod.

Now referring to FIG. 1C, the insect resistant frame 3 can include telescoping sections 61 that can be used to adjust the length of the insect resistant frame 3.

Now referring to FIGS. 2A-2C various connecting mechanism are show to connect sections of the insect resistant frame 3. In one exemplary embodiment as shown in MG. 2A, each of the plurality of connecting members 14 is made of a retaining block to allow the first set of rectangular shaped members 16 to be fixedly attached to the plurality of connecting members 14. The each end of first set of rectangular shaped members 16 is fixed in first slot 81.

A second set of rectangular shaped members 17 are flexibly attached to the plurality of connecting members 14 and can pivot 45 degrees relative to the first set of rectangular shaped members 16. Each end of the second set of rectangular shaped members 17 are fixed in second slot 82 in the first movable member 84. In one embodiment, the first movable member 84 is a rectangular block with second slot 82 at one end and a pivoting connection to the plurality of connecting members 14 at the other end.

A third set of rectangular shaped members 19 are flexibly attached to the plurality of connecting members 14 and can pivot 90 degrees relative to the first set of rectangular shaped members 16. Each end of the third set of rectangular shaped members 19 are fixed in third slot 85 in the second movable member 86. In one embodiment, the second movable member 86 is a rectangular block with a third slot 85 at one end and a pivoting connection to the plurality of connecting members 14 at the other end.

Now referring to FIG. 2B, in this exemplary embodiment the plurality of connecting members 14 includes a connecting hinge 31 made of hooks 32 configured to releasably attach to the plurality of connecting members 14. In this embodiment, release of the hooks 32 from the connecting hinge 31, allows the frame 3 to fold for storage.

Now referring to FIG. 2C, a "U" shaped hinge 34 in provided. The "U" shaped hinge 34 can be used in an exemplary embodiment to connect plurality of generally rectangular shaped members that make up the frame 3. The "U" shaped hinge 34 includes flexural element such as bearing 36 to allow the rectangular shaped members of frame 3 to bend or flex to less than 90 degrees. In an exemplary embodiment, one leg of the U shaped hinge 34 is shorter than the other so that one leg can be folded over the other.

Figure 3A:
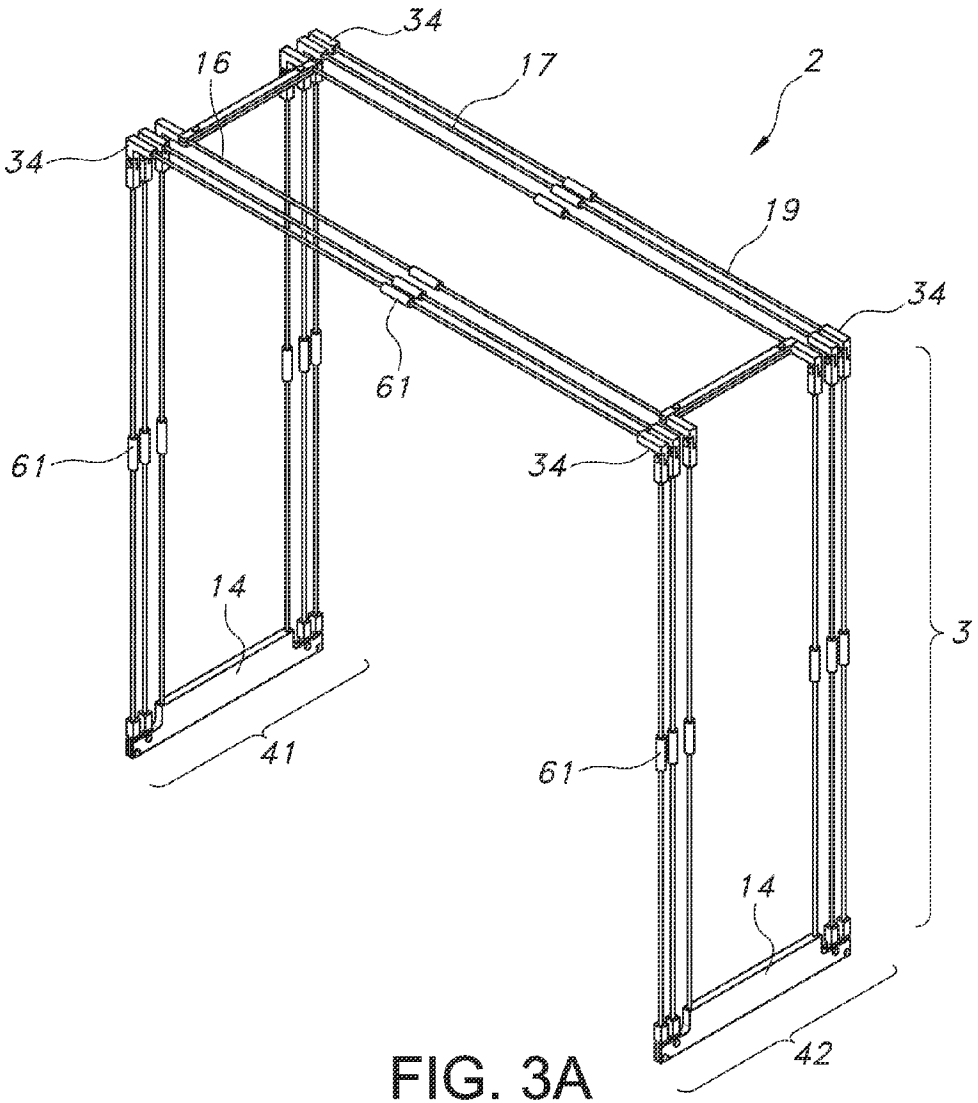
FIG. 3A is a perspective view of frame in the compressed configuration of the present invention.

Now referring to FIG. 3A the framed 3 is in the compressed position as shown. In the compressed position, the generally rectangular shaped members 16, 17, and 19 are perpendicular to the plurality of connecting members 14 and are in the same orientation having a U shape.

Figure 3B:
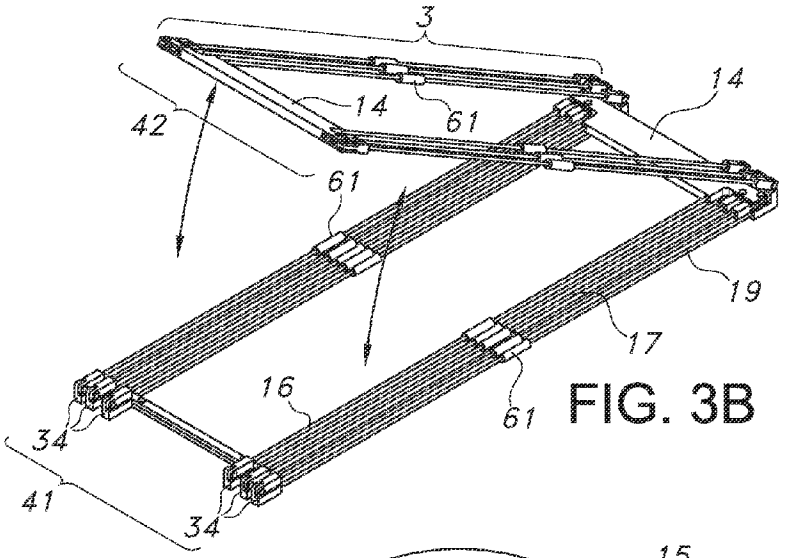
FIG. 3B is a perspective view of frame in the folded configuration of the present invention.
Figure 3C:
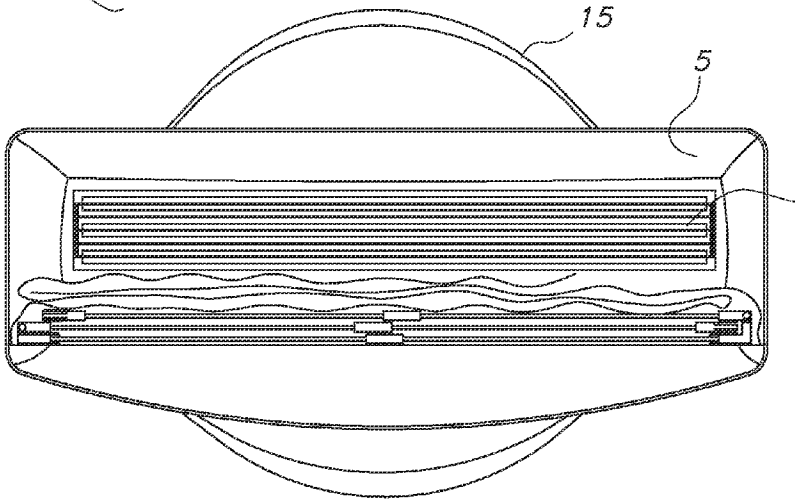
FIG. 3C is a perspective view of a portable bed apparatus of the present invention showing an exemplary embodiment of the storage container.

Now referring to FIGS. 3B-3C the sequence of steps to show the folding of the frame is provided. In this embodiment, sections of the insect resistant frame 3 are joined a "U" shaped hinge 34 to allow the frame to flex to less than 90 degrees to fold for storage The insect resistant frame 3 is folded by pivoting one side of a first group of rectangular shaped members 41 inwardly, by first flexing the "U" shaped hinge 34 whose length is shorter attached to the corner of the rectangular shaped members of insect resistant frame 3 to less than 90 degrees. Similarly, one side of a second group of rectangular shaped members 42 is moved inwardly, by flexing the "U" shaped hinge whose length is longer 34 attached to the corner of the rectangular shaped members of insect resistant frame 3 to less than 90 degrees. The folded frame 38 as shown in FIG. 3C is configured to form a base for a storage container 5 with handle 15.

Figure 4B:
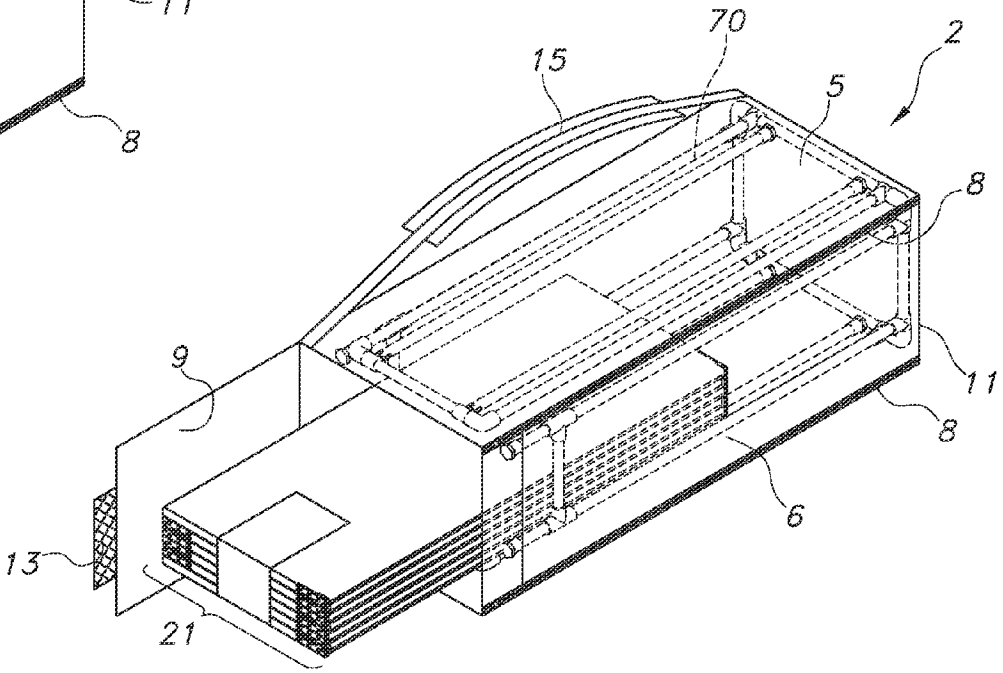
FIG. 4B is a perspective view of one embodiment of the storage container.
Figure 4A:
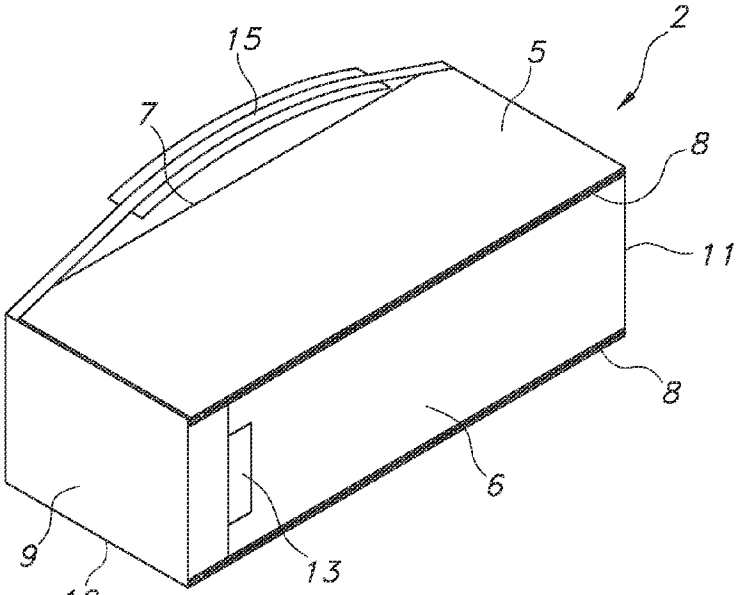
FIG. 4A is a perspective view of one embodiment of the storage container.

Now referring to FIGS. 4 A-C, and 6 an alternative embodiment of the portable bed apparatus, generally as 2 is shown. In this embodiment, the insect resistant frame 70 having a base 20 and a dome 72 can be transformed into a storage container 5 of a generally rectangular shape defined by four long side panels 6 and two short top panels 9, the storage container 5 being sized to contain a foldable bed frame 21, when the foldable bed frame 21 is in the folded position; wherein the four long side panels have a plurality of re-sealable openings 8 located between the long side panels, and wherein the storage container 5 expands to form an insect resistant frame 70 having a base 20 and a dome 72, when the re-sealable openings 8 located between the long side panels 6 are in the open position.

The storage container 5 has four long side panels 6 and two smaller top panels 9. The four long side panels 6 can include reinforcing rods 7 in the junctions between four long side panels 6. The reinforcing rods 7 help the storage container 5 maintain a generally rectangular shape, when not deployed to form the dome 72. In this configuration, the storage container 5 is sized to accommodate a portable bed frame 21 in the folded position.

A plurality of re-sealable openings 8 is located between the four long side panels 6. The re-sealable openings 8 are preferably zippers. One of the two smaller panels 9 is a fixed panel 11, while the second smaller panels 9 form an openable panel 12 with closing tab 13, positioned to secure the openable panel 12 to the storage container 5. The storage container 5 includes a handle 15 that can be secured to the one of the four long side panels 6 or one of the two top panels 9. The storage container 5 is preferably made of a strong mesh.

Figure 4C:
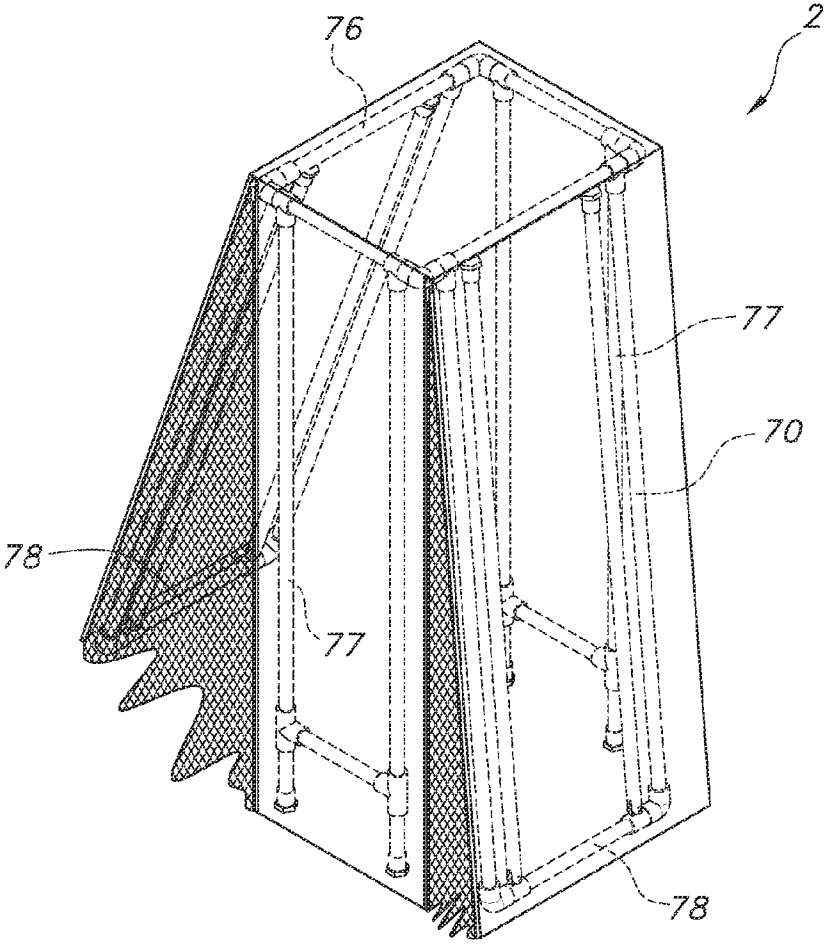
FIG. 4C is a perspective view of one embodiment of the storage container.
Figure 6:
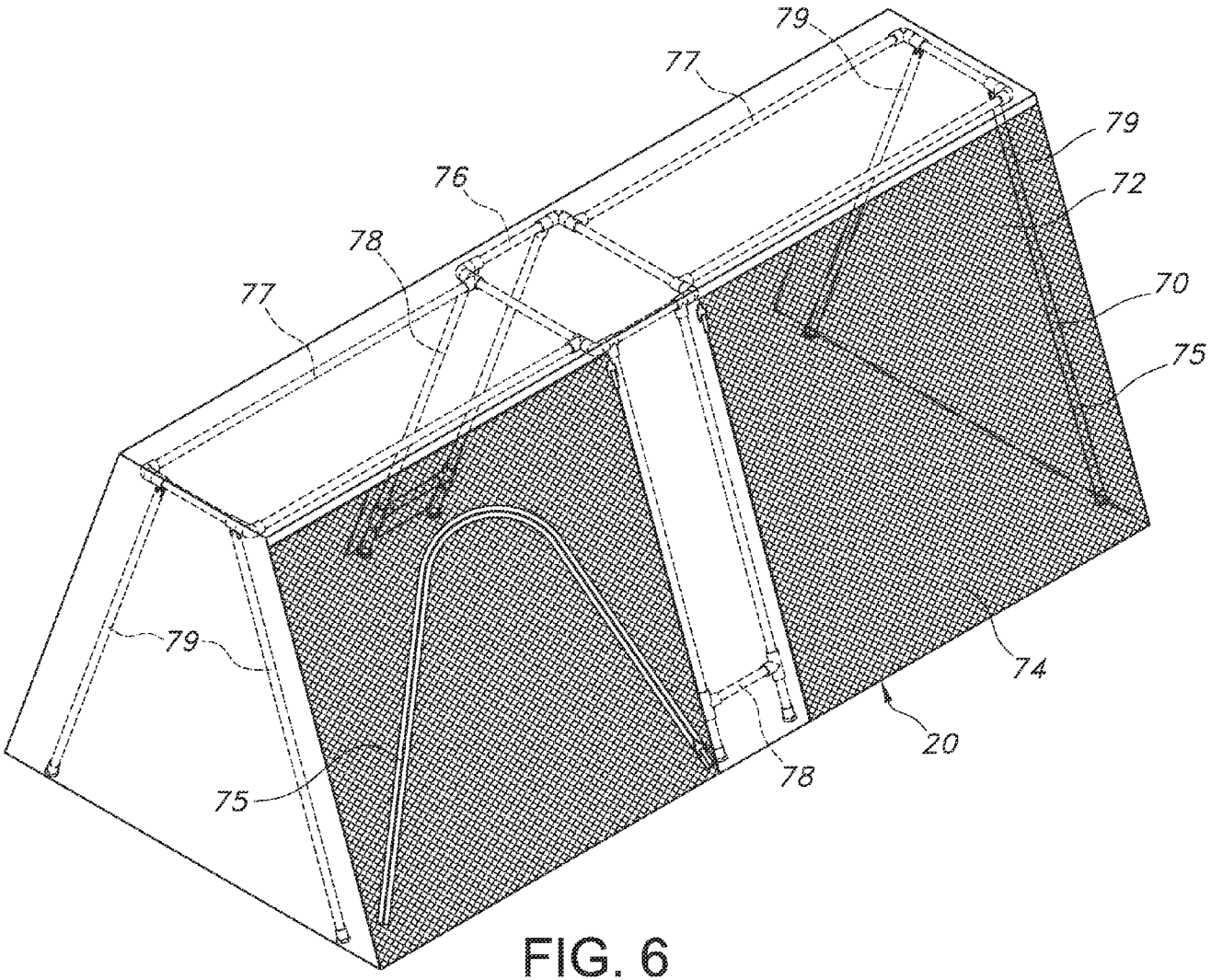
FIG. 6 is a perspective view of one embodiment of the dome.

In FIG. 4C and FIG. 6 the re-sealable openings 8 are configured to open to allow the four long side panels 6 to expand to form a dome 72. In this embodiment, a middle frame section 76 has attached thereto two middle vertical sections 78 and two middle horizontal sections 77, two middle horizontal sections 77 are attached to the two middle vertical sections 78. The insect resistant frame 70 has a base 20 and a dome 72. The generally rectangular base 20 area is configured to receive the associated sleeping ware, such as a bed cushion 50, cover sheet 60, blanket (not shown) and pillow 37.

The insect resistant frame 70, with insect proof net 74 is released to cover the dome 72 that can completely cover the foldable bed frame 21, in the unfolded position. A plurality of openings 75 allows a user to enter and exit the dome 72. The frame 70 is configured in the extended portion to form a trapezoid.

Figure 5A:
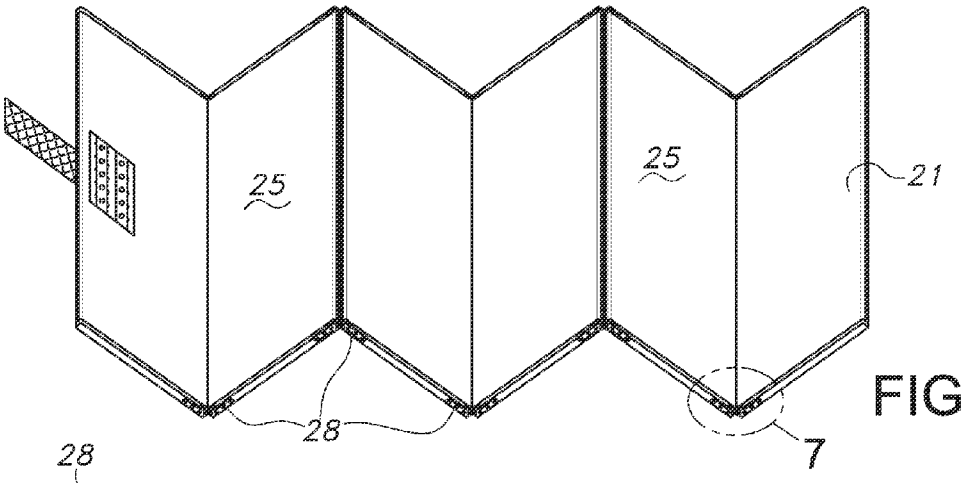
FIG. 5A is a perspective view of one embodiment of the foldable bed frame.
Figure 5B:
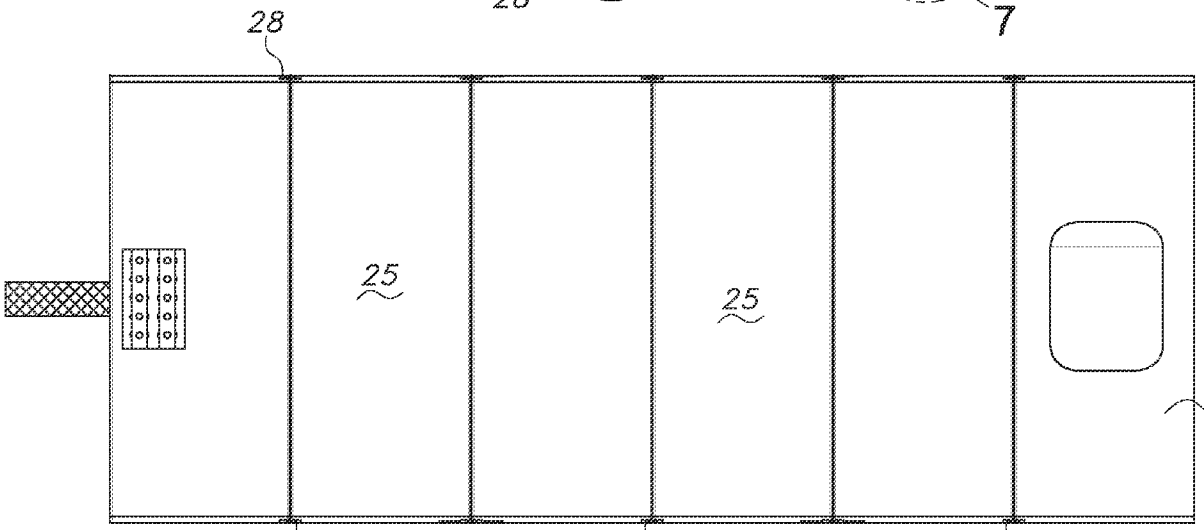
FIG. 5B is a perspective view of one embodiment of the foldable bed frame.

Now referring to FIGS. 5A-B the foldable bed frame 21 of the portable bed apparatus 2 is shown in the partially folded position FIG. 5A and in the unfolded position FIG. 5B. In this embodiment, the foldable bed frame 21 is made of a plurality of bed panels 25, each made of plastic or an aluminum material. Each of the plurality of bed panels 25 are generally rectangular shaped and are arranged in a linear array. The foldable bed frame 21, in the preferred embodiment, is formed of separate bed panels 25 with PVC or EVA-foam tiles that cover the center of each of the plurality of bed panels 25.

In one embodiment, each of the plurality of bed panels 25 is joined by a hinge 28, preferably a pair of hinges. A plurality of bed panels 25, each of the plurality of bed panels 25 having an interior tile, an "L" shaped hinge connected each of the plurality of bed panels 25, wherein a hinge on one of the bed panels 25 is connected to a hinge 28 on another of the bed panels 25. In an alternate embodiment, the bed panel 25 is made of a foldable bed cushion 50 that is sufficiently flexible to be folded.

The portable bed apparatus 2 further includes sleeping ware such as a bed cushion 50, cover sheet 60, blanket (not shown) and pillow 37. A hinge 28, in one embodiment, forms an "L" shape and is connected to each other, to allow the bed panel 25 to pivot with respect to each other. As the hinge 28 is flexed to the open position, foldable bed frame 21 achieves the flat position. When the hinge 28 is flexed to the closed position, the foldable bed frame 21 forms a rectangular shape.

Figure 7:
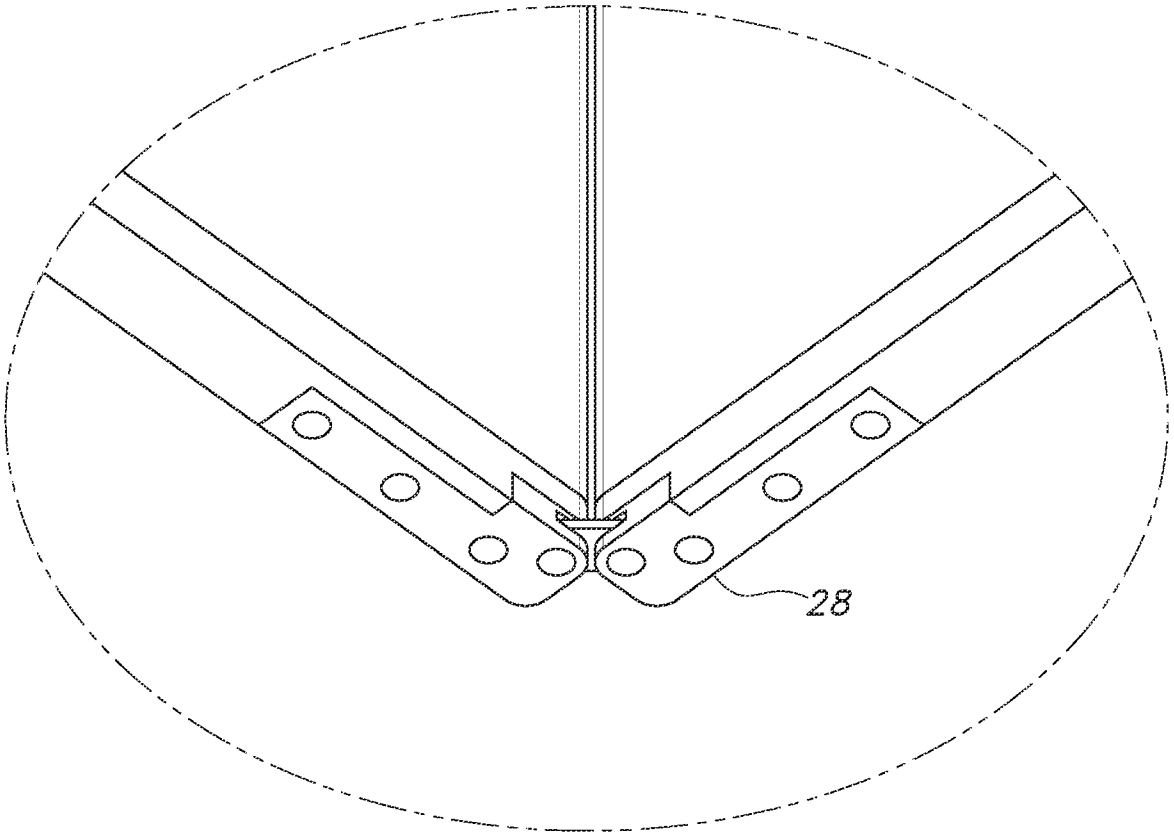
FIG. 7 is an exemplary view of a connecting hinge.

FIG. 7 shows the attachment of a hinge 28 to two of the plurality of bed panel frame panels 25. Each of the hinges 28, in the preferred embodiment, form an "L" shape and are connected to each other, to allow the bed panel frames 25 to pivot with respect to each other. As the hinge 28 is flexed to the open position, the foldable insect resistant frame 70 achieves the flat position. When the entire hinge 28 is flexed to the closed position, the foldable insect resistant frame 70 forms a rectangular shape.

It is intended that the foregoing description is only illustrative of the present invention and that the present invention be limited only by the hereinafter appended claims.

The invention claimed is:

1. A portable bed apparatus comprising:

an insect resistant frame configured to form a base and a dome comprised of: a plurality of generally rectangular shaped members and a plurality of connecting members, each end of the plurality of generally rectangular shaped members positioned in one of the plurality of connecting members, wherein the apparatus has a compressed position and an extended position, in the compressed position, the plurality of generally rectangular shaped members are substantially perpendicular to the plurality of connecting members and in the extended position at least two of the plurality of generally rectangular shaped members are substantially parallel to the plurality of connecting members and form a base to receive an associated sleepwear and to retain an insect resistant net; and at least two of the plurality of generally rectangular shaped members of the plurality of generally rectangular shaped members form a dome to define a space above the base wherein said at least two of the plurality of generally rectangular shaped members are configured to retain the insect resistant net, wherein the plurality of generally rectangular shaped members is comprised of a first set of rectangular shaped members fixed in the plurality of connecting members, wherein the plurality of generally rectangular shaped members is comprised of a second set of rectangular shaped members flexibly attached to the plurality of connecting members which are configured to pivot 45 degrees relative to the first set of rectangular shaped members; wherein in the plurality of generally rectangular shaped members is comprised of a third set of rectangular shaped members flexibly attached to the plurality of connecting members which are configured to pivot 90 degrees relative to the first set of rectangular shaped members, wherein each of the plurality connecting members is comprised of a retaining block, wherein said retaining block has a raised middle section with a plurality of slots configured to fixedly retain the first set of rectangular shaped members within the retaining block, wherein the retaining block is comprised of two detachable sections, wherein one of the detachable sections comprises a hook configured to releasably attach to the other detachable section of the connecting member.

2. A method of using a portable bed apparatus made of an insect resistant frame forming a base and a dome comprising the steps of:

a) providing the portable bed apparatus of claim 1;

b) extending the insect resistant frame to form the dome and the base; and c) positioning the associated sleepwear within the base.

3. The method of claim 2 further comprising the step of:

collapsing the insect resistant frame by folding the third set of rectangular shaped members over the second set of rectangular shaped members and folding the second set of rectangular shaped members over the first set of rectangular shaped members to form a folded frame and inserting said folded frame into a storage container.

* * * * *